US007572140B2

(12) United States Patent
Szelag et al.

(10) Patent No.: US 7,572,140 B2
(45) Date of Patent: Aug. 11, 2009

(54) CABLE CLAMPING ELECTRICAL PLUG

(75) Inventors: Martin Szelag, Bickenbach (DE); Ralf Schmidt, Fuerth (DE); Bert Bergner, Bensheim (DE); Werner Boeck, Gross-Umstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/828,429

(22) Filed: Jul. 26, 2007

(65) Prior Publication Data

US 2008/0050965 A1 Feb. 28, 2008

(30) Foreign Application Priority Data

Aug. 24, 2006 (DE) ..... 10 2006 039 799

(51) Int. Cl.
*H01R 4/24* (2006.01)

(52) U.S. Cl. ..... 439/405; 439/596; 439/598; 439/409

(58) Field of Classification Search ..... 439/405, 439/397, 596, 598, 418, 409
See application file for complete search history.

(56) References Cited

U.S. PATENT DOCUMENTS 2,673,968 A 3/1954 Smith
3,879,099 A 4/1975 Shaffer
4,062,616 A 12/1977 Shaffer et al.
4,138,184 A * 2/1979 Knopp ..... 439/399
5,295,857 A * 3/1994 Toly ..... 439/395
5,947,761 A * 9/1999 Pepe ..... 439/409
6,887,094 B2 * 5/2005 Boeck et al. ..... 439/417
7,001,204 B1 * 2/2006 Lin ..... 439/418
2001/0012722 A1 * 8/2001 Adams ..... 439/418
2003/0139094 A1 * 7/2003 Venditti et al. ..... 439/596
2005/0124206 A1 6/2005 Bergner et al.

FOREIGN PATENT DOCUMENTS

DE 10 2004 038 123 A1 8/2004
EP 0 991 149 B1 8/2004

OTHER PUBLICATIONS

European Search Report dated Jul. 30, 2007 for Application No. EP 07013232.

* cited by examiner

*Primary Examiner*—Briggitte R Hammond
*Assistant Examiner*—Vanessa Girardi
(74) *Attorney, Agent, or Firm*—Barley Snyder LLC

(57) ABSTRACT

An electrical plug comprises first and second housings rotatable between an open position and a closed position. The first and second housings each have contact elements arranged therein. A cable end seating is arranged between the first and second housings. The cable end seating has a first surface facing the first housing and an opposing second surface facing the second housing. The first and second surfaces are each provided with at least one seating for receiving a conductor element of a cable to be connected to the plug. The contact elements electrically contact the conductor elements when the first and second housings are in the closed position.

13 Claims, 7 Drawing Sheets

CABLE CLAMPING ELECTRICAL PLUG

CROSS-REFERENCE TO RELATED APPLICATIONS

This application claims the benefit of the filing date under 35 U.S.C. § 119(a)-(d) of German Patent Application No. DE 10 2006 039 799.1, filed Aug. 24, 2006.

FIELD OF THE INVENTION

The invention relates to an electrical plug for connection to a plug seating wherein the plug includes first and second housings rotatable into engagement with a cable end seating arranged therebetween.

BACKGROUND

From the prior art, traditional 8-pole RJ-45 plugs, which mostly consist of transparent plastic, are known. To fix a cable, individual conductors of the cable are pushed or plugged into a housing of the plug. Using a crimping tool, the cable is then pressed firmly onto the plug. However, these plugs have the disadvantage that they can only be connected to a cable at great cost in force and time. Additionally, such plugs are unsuitable for repeated connection. In the case of many plugs, a separate assembly slide is also used to insert the individual conductors of the cable. However, such separate parts have the disadvantage that they are easily lost.

EP 0 991 149 B1 teaches an RJ-45 high frequency plug comprising a housing, a contact housing, which can be inserted into the housing, and shielding. The contact housing has several seatings, into which conductors of a cable are inserted. Additionally, insulation displacement connection contact elements are inserted into the contact housing. To connect the cable to the plug, the individual conductors of the cable are inserted into the contact housing in a predetermined sequence, in parallel and in two planes, and at a predetermined distance from each other. There the conductors of the cable are each connected, via an insulation displacement connection to an insulation displacement connection contact element with a corresponding contact.

Additionally, DE 10 2004 038 123 A1 teaches an electrical plug comprising a first housing and a second housing. The second housing is designed so that the second housing can swivel relative to the first housing. A plug contact area is rigidly connected to either the first or second housing. An insulation device with insulation displacement connection contacts is fixed in the first housing. Additionally, a swivelling cable end seating is arranged between the first and second housings. The cable end seating has four channels, into which individual conductors of a cable to be connected to the plug are inserted or plugged. By swivelling the cable end seating with the cable to the first housing, the individual conductors are contacted. This is done by the insulation displacement contacts, which cut through the insulation of each individual conductor and contact the individual conductors.

A problem of the prior art described above is that it requires a lot of force and time to connect the multipole, i.e. eight-pole, plugs to the cable. Additionally, other types of plugs allow for rapid connection of the cable, but have less space for connections for the conductor elements.

BRIEF SUMMARY

The object of the invention is therefore to provide an electrical plug that enables a quick and easy method for connection of a cable while optimizing the amount of available space in the plug.

This and other objects are achieved by an electrical plug comprising first and second housings rotatable between an open position and a closed position. The first and second housings each have contact elements arranged therein. A cable end seating is arranged between the first and second housings. The cable end seating has a first surface facing the first housing and an opposing second surface facing the second housing. The first and second surfaces are each provided with at least one seating for receiving a conductor element of a cable to be connected to the plug. The contact elements electrically contact the conductor elements when the first and second housings are in the closed position.

DETAILED DESCRIPTION OF THE EMBODIMENT(S)

Figure 1:
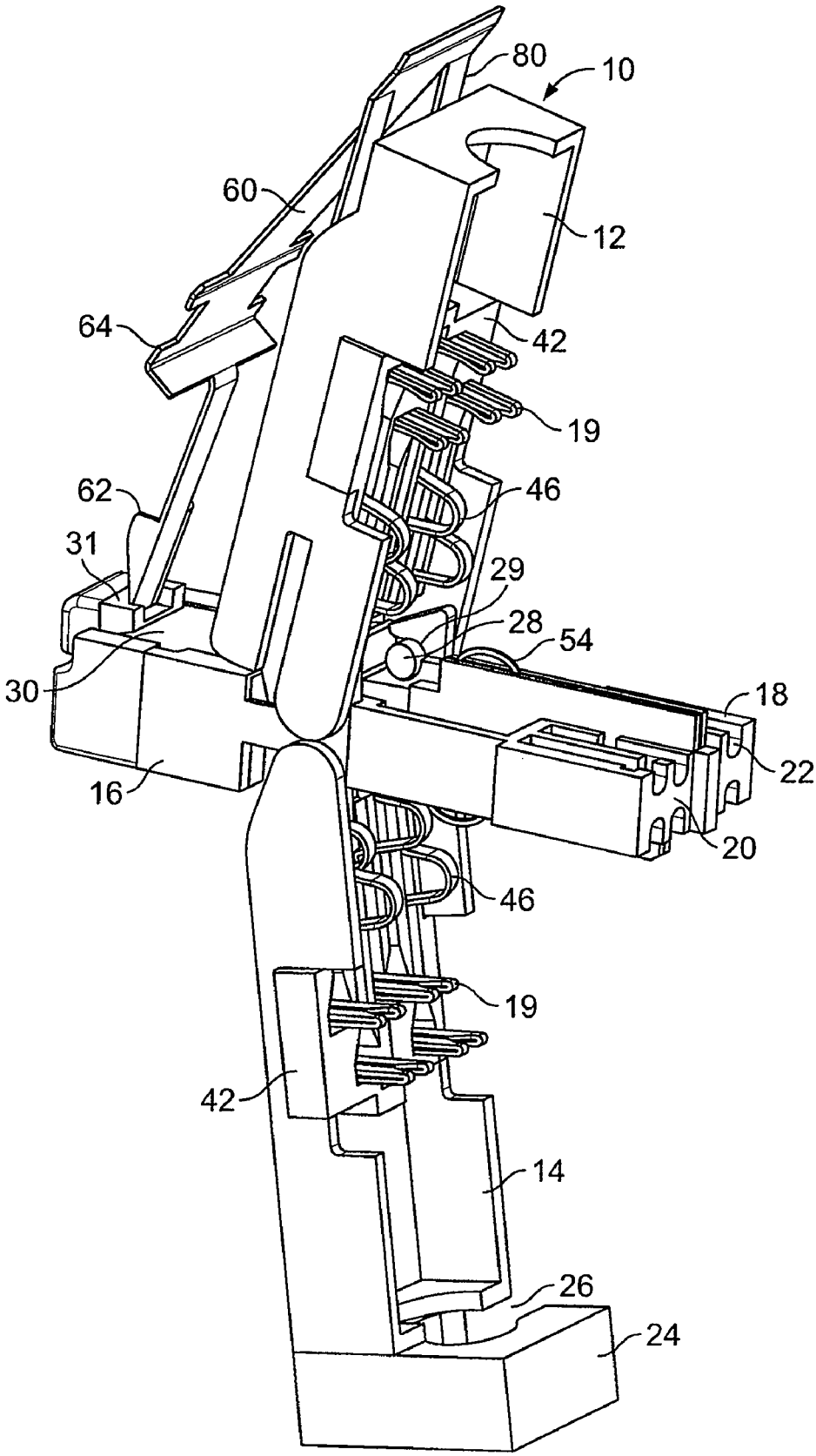
FIG. 1 is a perspective view of a first embodiment of an electrical plug according to the invention showing the plug in an open position.
Figure 2:
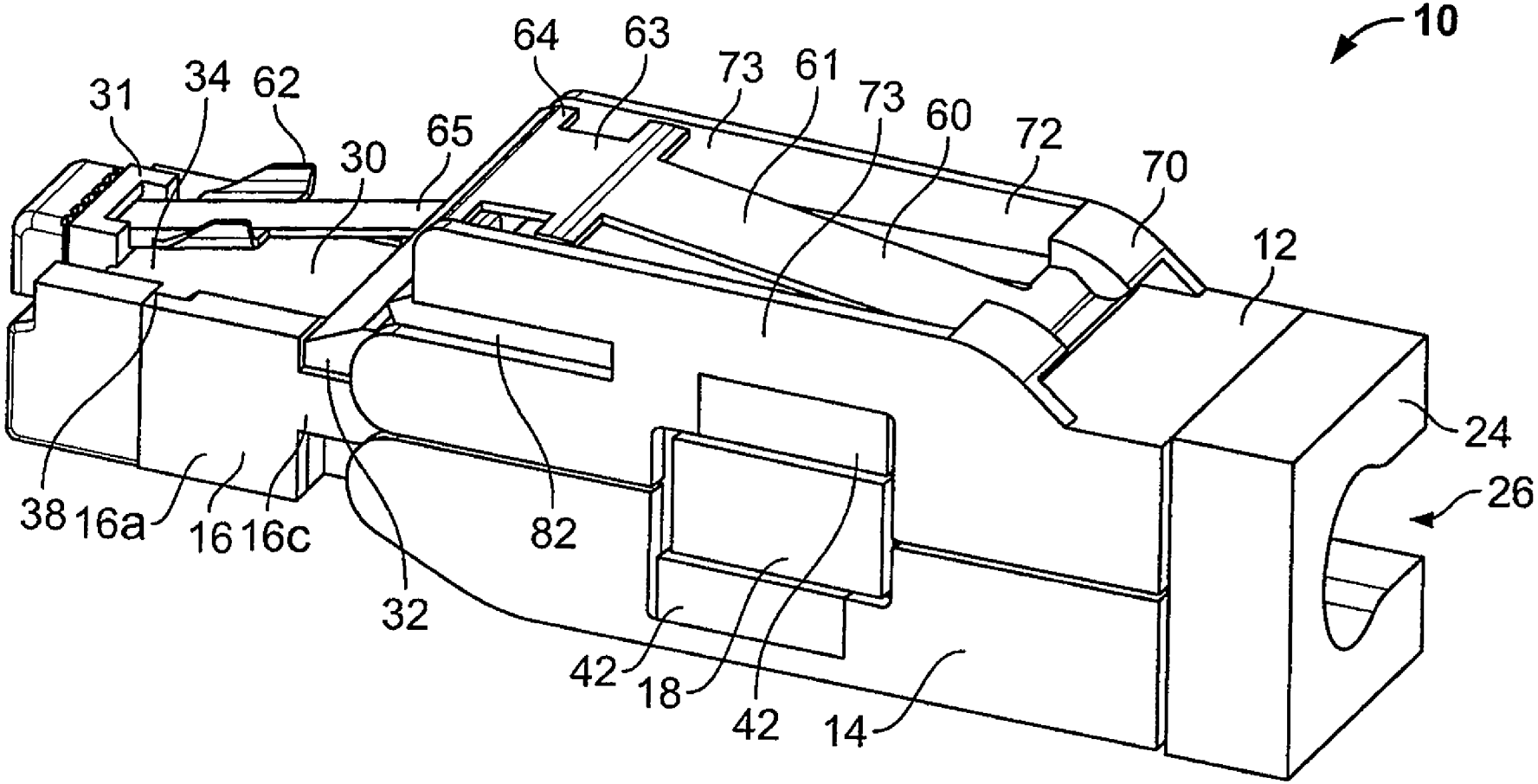
FIG. 2 is a perspective view of the plug of FIG. 1 showing the plug in a closed position.
Figure 3:
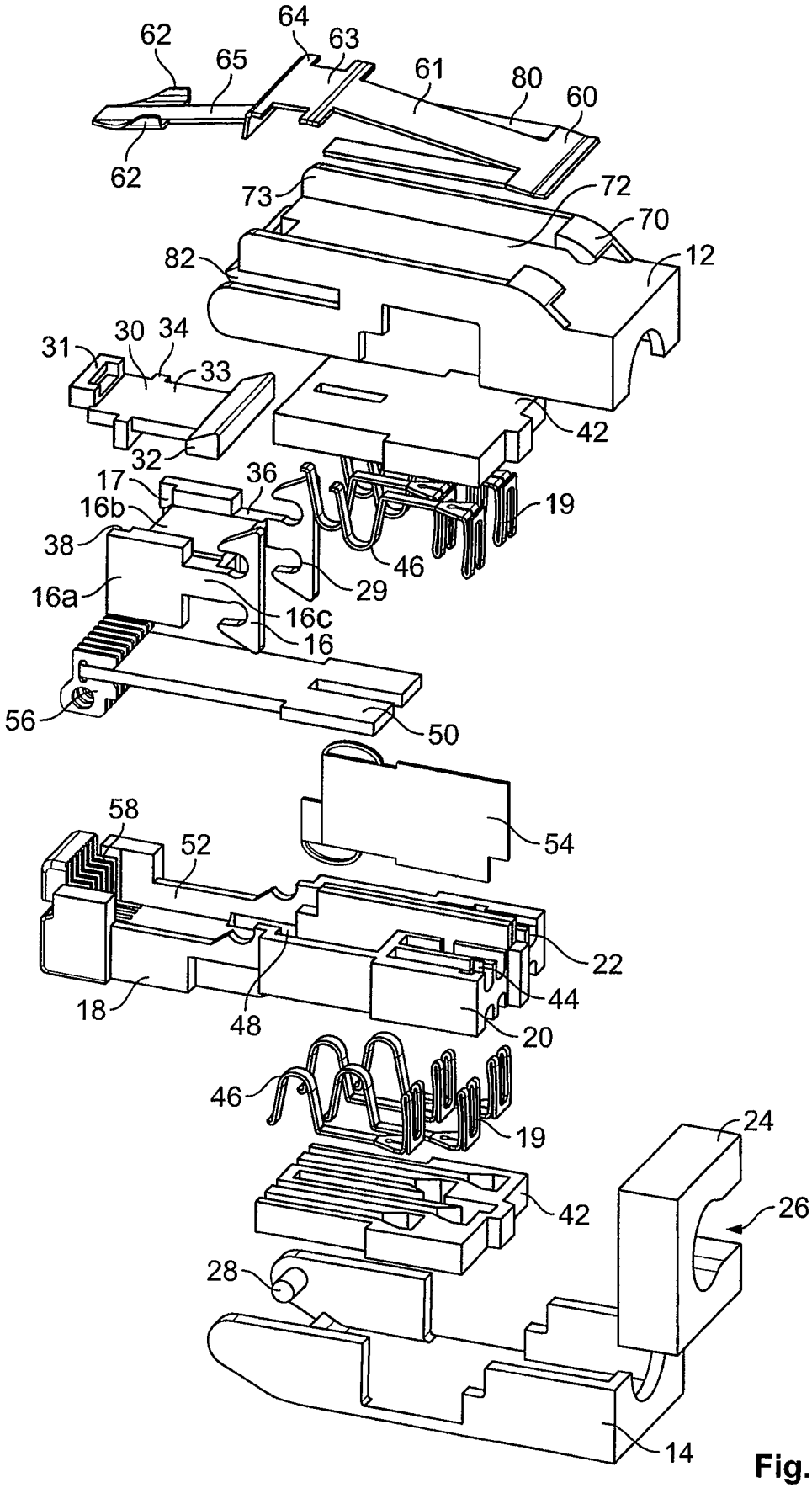
FIG. 3 is a perspective exploded view of the plug of FIG. 1.

FIGS. 1-3 show a first embodiment of an electrical plug 10 according to the invention. As shown in FIG. 1, the plug 10 includes a first housing 12, a second housing 14, a third housing 16 and an insulation device 18. As shown in FIGS. 1 and 3, the first housing 12 is provided with a contact carrier 42 on an inside surface thereof. Contact elements 19 are provided in the contact carrier 42. The contact elements 19 have contact sections 46. The contact sections 46 may be formed, for example, as spring contacts. Journals or projections 28 extend from inside surfaces of opposing side walls of the first housing 12. The first housing 12 has seating sections 70 and a seating 72. The seating 72 is delimited by side walls 73. Grooves 82 are provided on the side walls 73. The grooves 82 are formed substantially parallel to a plugging direction in which the plug 10 is plugged into a plug seating (not shown).

Figure 4:
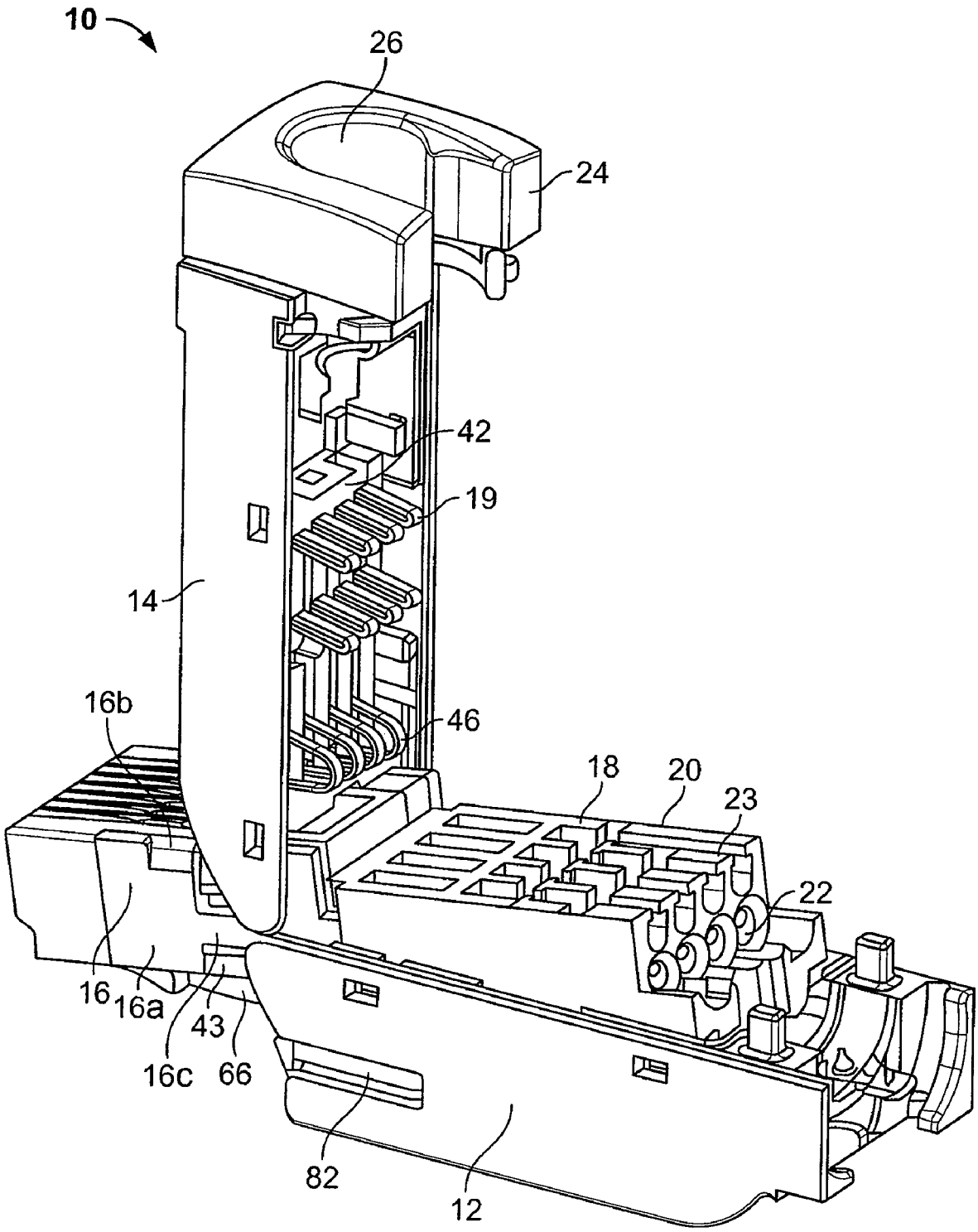
FIG. 4 is a perspective view of a second embodiment of an electrical plug according to the invention showing the plug in an open position.
Figure 5:
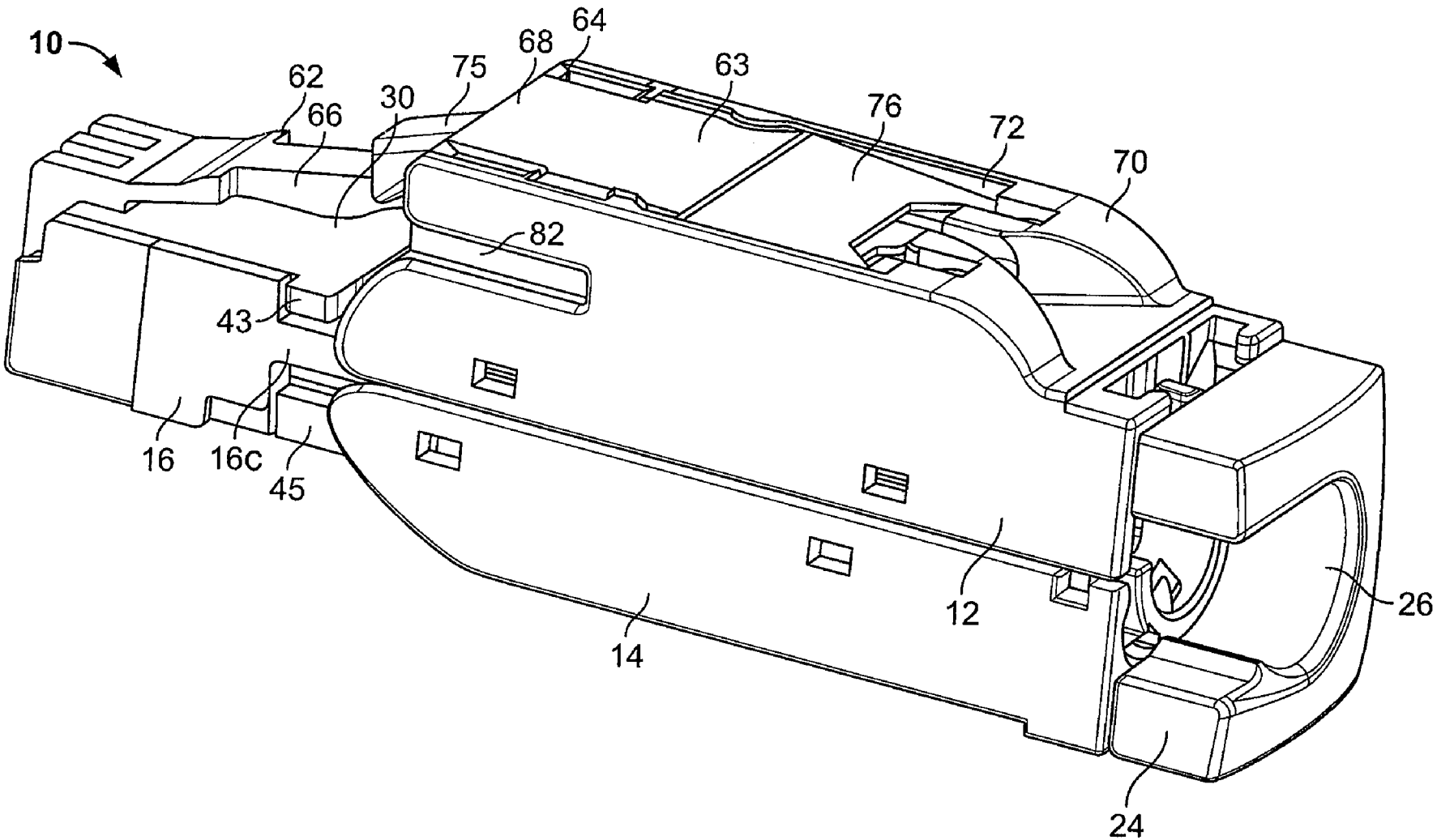
FIG. 5 is a perspective view of the plug of FIG. 4 showing the plug in a closed position.

As shown in FIGS. 1 and 3, the second housing 14 is connected to the first housing 12 such that the first and/or second housings 12, 14 can swivel between an open position (FIGS. 1, 4 and 7) and a closed position (FIGS. 2 and 5). The second housing 14 is provided with the contact carrier 42 on an inside surface thereof. The contact elements 19 are provided in the contact carrier 42. The contact elements 19 have the contact sections 46. The contact sections 46 may be formed, for example, as spring contacts. The second housing 14 is provided with a moveable locking element 24. The locking element 24 has a substantially U-shaped opening 26 for feeding a cable (not shown) which is inserted into the plug 10 when the plug 10 is in a closed position. The locking element 24 is configured such that the locking element 24 can be rotated around an axis of the cable (not shown) by about 90 degrees from an unlocked position (FIGS. 6-7) to a locked position (FIGS. 2 and 5). The locking element 24 may be formed to be rotated by hand or may be provided with a seating or an opening 25 (FIG. 6) for receiving a tool, such as a screwdriver, for rotating the locking element 24. Journals or projections 28 extend from inside surfaces of opposing side walls of the second housing 14.

The contact elements 19 of the first and second housings 12, 14 may be, for example, insulation displacement connection contacts, such as the so-called Folded Over contacts manufactured by the Tyco Electronics AMP Company where multiple contacting of different wire cross-sections, preferably AWG 22, 24, 26, is possible. For example, a massive wire can be used nine times, and a flex can then be used for the tenth time. It will be appreciated by those skilled in the art, however, that other contact elements or combinations of thereof are conceivable for contacting the cable conductor elements.

As shown in FIGS. 1 and 3, the third housing 16 has sides 16*a* separated by a connecting member 16*b*. The sides 16*a* and the connecting member 16*b* are configured to form a substantially H-shape. Each of the sides 16*a* has an extension 16*c* at a front end thereof. The grooves 82 on the first housing 12 and the extensions 16*c* are configured to guide the plug 10 in the plug seating (not shown). Each of the extensions 16*c* has at an end thereof seatings 29 configured for receiving the corresponding projections 28 of the first and second housings 12, 14 such that the projections 28 are locked into and rotatably supported by the seatings 29. The connecting member 16*b* extends along the extensions 16*c* such that the connecting member 16*b* can reinforce the extensions 16*c*. The extensions 16*c* form a front seating 36 on a top surface of the third housing 16. Each of the sides 16*a* projects beyond the connecting member 16*b* and forms a rear seating 38. Each of the sides 16*a* has an indentation 17 formed therein at an end thereof.

A detent element 30 is provided on the top surface of the third housing 16. The detent element 30 consists of a base 33. A wedge-shaped section 32 is arranged on a front end of the base 33 and laterally projects therefrom. The wedge-shaped section 32 is configured such that the wedge-shape section 32 is received in the front seating 36. The wedge-shaped section 32 is formed such that it adjoins the seating 29 and has a width and height such that the wedge-shaped section 32 obstructs the seating 29 sufficiently so that the projections 28 of the first housing 12 can not accidentally slip out of the seatings 29. A projection 34 is formed on both sides of the base 33 and a bottom surface thereof and is configured for receipt into the indentations 17 and the rear seating 38. A seating 31 is provided on a rear end of the base 33. The detent element 30 is dimensioned so that it can be received substantially flush into the third housing 16. The third housing 16 is received substantially flush into appropriately dimensioned seatings of the insulation device 18.

As shown in FIGS. 1 and 3, the insulation device 18 is provided between the first and second housings 12, 14. The insulation device includes a cable end seating 20. The insulation device 18 can be formed in one piece with the cable end seating 20. The cable end seating 20 has seatings 22 provided on a first surface that faces the first housing 12 and a second surface opposite from the first surface that faces the second housing 14. The seatings 22 correspond to the contact elements 19. In the illustrated embodiment, the cable end seating 20 has a total of eight of the seatings 22 to form an 8-pole plug arrangement (four provided on opposing top and bottom sides thereof); however, it will be appreciated by those skilled in the art that any number of the seatings 22 may be provided. The seatings 22 are configured to receive conductor elements or individual conductors of the cable (not shown) that is to be connected to the plug 10. For example, the seatings 22 may be in the form of recesses, elongated holes opened at a top thereof, borings or at least partly closed channels. With respect to the at least partly closed channels, when the seating 22 is provided on the second surface of the cable end seating 20, the conductor element is held reliably in the seating 22 and can not fall out undesirably. The seatings 22 have recesses 44 for entry of the contact elements 19.

The insulation device 18 can optionally be provided with a shroud 54. For this purpose, the insulation device 18 has a seating section with a slot for seating the shroud 54. The shroud 54 divides the cable end seating 20 into two halves. For example, in the illustrated embodiment, the shroud 54 divides the cable end seating 20 into two halves each having four of the seatings 22. The shroud 54 thereby improves electrical transmission properties.

A printed circuit board element 50 is provided in a top surface of the insulation device 18. The printed circuit board element 50 is preferably lead-free. The printed circuit board element 50 has flat contact elements 56 arranged at one end of the printed circuit board element 50. The printed circuit board element 50 is arranged in a seating 52 of the insulation device 18, and the flat contact elements 56 are arranged in seatings 58 of the insulation device 18. Contact sections 46 of the contact elements 19 are pressed through an opening 48 in the insulation device 18 against the printed circuit board element 50 to electrically connect the contact elements 19 and flat contact elements 56 to each other via tracks (not shown) on the printed circuit board element 50 when the first and second housings 12, 14 are in the closed position. The printed circuit board element 50 can also be provided with at least one additional electrical circuit (not shown), which affects or improves the electrical transmission properties for data networks, for example, fast data networks in the gigabit range, by electrical compensation methods.

The first and second housings 12, 14 swivel via the third housing 16 toward the insulation device 18 between the open position and the closed position. When the first and/or second housings 12, 14 are folded together, the contact elements 19 cut the insulation on the conductor elements and make electrical and mechanical contact with the corresponding conductor elements. Simultaneously, the contact sections 46 of the contact element 19 are pressed through the opening 48 in the insulation device 18 against the printed circuit board element 50. The locking element 24 is rotated from the unlocked position to the locked position to hold the first and second housings 12, 14 firmly together. As a result, the first and second housings 12, 14 may be easily locked and unlocked such that repeated connection of the cables (not shown) is possible without the use of a crimping tool. The locking element 24 represents only one of several possible ways of joining the first and second housings 12, 14 to each other easily and re-sealably.

A spring element 60 is connected to the first housing 12 and the insulation device 18. The spring element 60 can have varying elastic properties. The spring element 60 consists, for example, of a stamped metal sheet and has a first diagonal section 61 and a second diagonal section 65 connected via a connecting section 63. Side arms 80 are provide adjacent the first diagonal section 61 and extend substantially parallel to the first housing 12. The first diagonal section 61 extends diagonally upwards to the connecting section 63. The connecting section 63 extends substantially parallel to the first housing 12 and is connected to the second diagonal section 65. The second diagonal section 65 extends diagonally downwards. The second diagonal section 65 has first securing elements 62 to lock the plug 10 in a plug seating such as a RJ-45 socket (not shown). The first securing elements 62 may be, for example, stamped from a metal sheet and bent upwards into hooks. Second securing elements 64 are formed on the connecting section 63 to additionally lock the plug 10 in the plug seating. The second securing elements 64 can supplement or replace the first securing elements 62, so that a retention force of the plug 10 is achieved mainly or entirely by the catch of the second securing elements 60.

To attach the spring element 60 to the first housing 12 and the insulation device 18, a front end of the detent spring 60 is arranged in the seating sections 70 and an end of the second diagonal section 65 is received in the seating 31 of the detent element 30 to lock the spring element 60 on the first housing 12. The side arms 80 are supported in the seating 72 of the first housing 12. The side walls 73 on the first housing 12 position and guide the spring element 60. The spring element 60 remains braced on the first housing 12 after the cable (not shown) is inserted, as shown in FIG. 1, to lock the plug 10 in the plug seating (not shown). A plug with a spring element and first and second securing elements and a plug seating, are described in the above-mentioned DE 10 2004 038 123 A1 of Tyco Electronics AMP.

To remove the plug 10 from the plug seating (not shown), pressure is exerted on the first diagonal section 61 of the spring element 60, downwards in the direction of the second housing 14. In this way, the connecting section 63 and the second diagonal section 65 are also pressed downwards, and the first and second securing elements 62, 64 are released from the plug seating, so that the plug 10 can be removed. The pressure can either be exerted by hand, or, if access is difficult, with a screwdriver, which may be guided between the seating sections 70. Merely to connect the cable (not shown) to the plug 10, the front end of the spring element 60 can be released from its bracing in the seating sections 70 and the first housing 12 can be folded upwards, as shown in FIG. 1.

FIGS. 4-7 show a second embodiment of a plug according to the invention. Elements of the second embodiment that are identical or substantially identical to elements of the first embodiment will be represented with the same reference numerals. Additionally, only the elements of the second embodiment that are substantially different form the elements of the first embodiment will be described in further detail hereafter.

Figure 6:
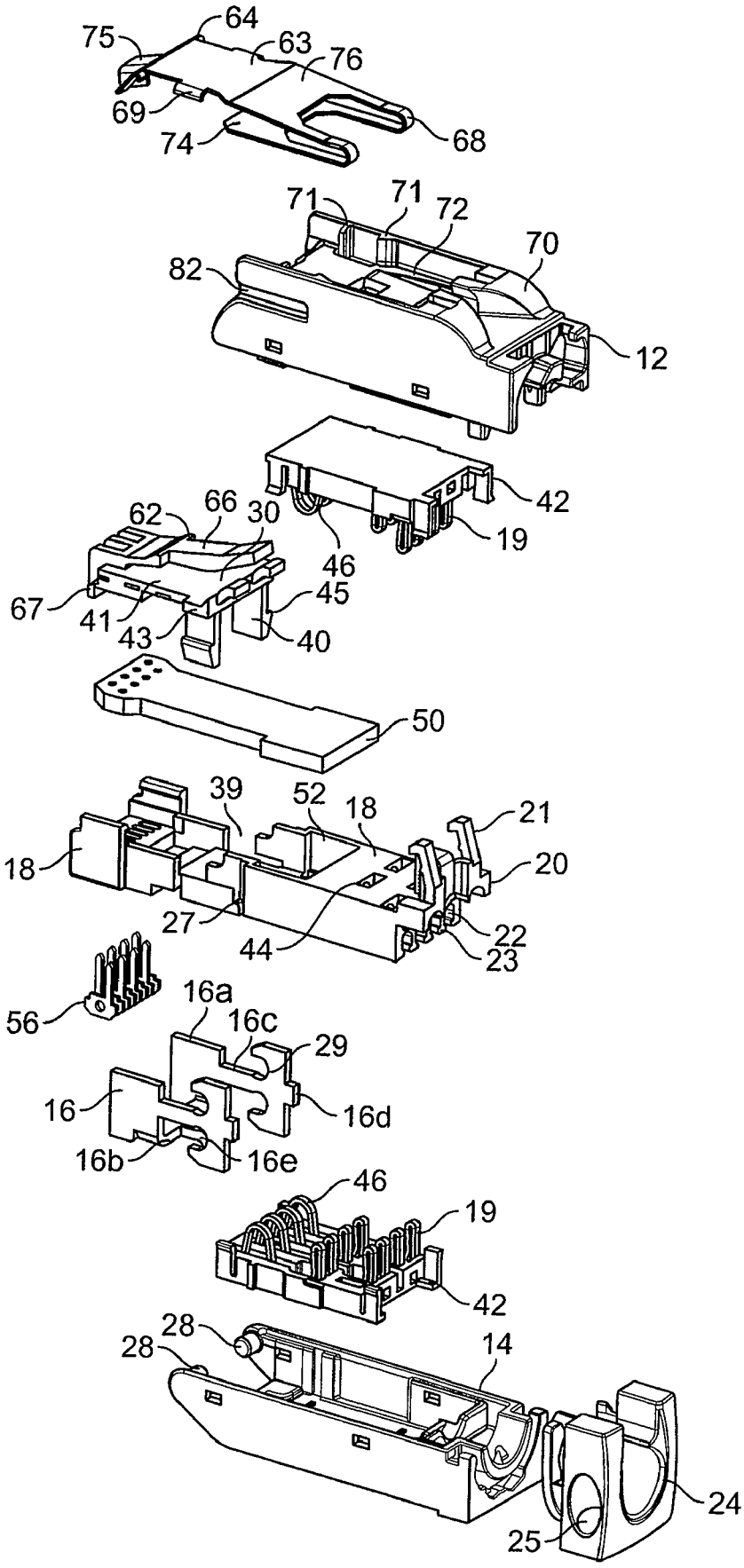
FIG. 6 is a perspective exploded view of the plug of FIG. 4.

As shown in FIG. 6, the flat contact elements 56 are attached or pre-assembled in solderless press-in technology in the insulation device 18. The contact elements 19 and the flat contact elements 56 are connected to each other in an electrically conducting manner via tracks (not shown) on the printed circuit board element 50, when the first and second housings 12, 14 are in the closed position. Securing members 21 are formed on the cable end seating 20 on the insulation device 18.

As shown in FIG. 6, the third housing 16 may be formed from a metal sheet bent in a substantially U-shape to form the sides 16*a* and the connecting member 16*b*. A side of the third housing 16 opposite a side of the extensions 16*c*, which is not connected to the connecting member 16*b*, is configured to form a seating for a correspondingly shaped section of a plug-in contact area of the insulation device 18, as shown in FIG. 4. As shown in FIG. 6, the seatings 22 have channels with clamping grooves 23 on a top side, and the seatings 22 have channels in the form of borings on the bottom side. A projection 16*d* is provided at an end of the seatings 29.

As shown in FIG. 6, the insulation device 18 has an attachment member 27 configured to receive the projection 16*d* of the third housing 16 when the third housing 16 is pushed from below into a correspondingly shaped seating of the insulation device 18. The projection 16*d* and the attachment member 27 are configured to lock the third housing 16 on the insulation device 18.

Figure 7:
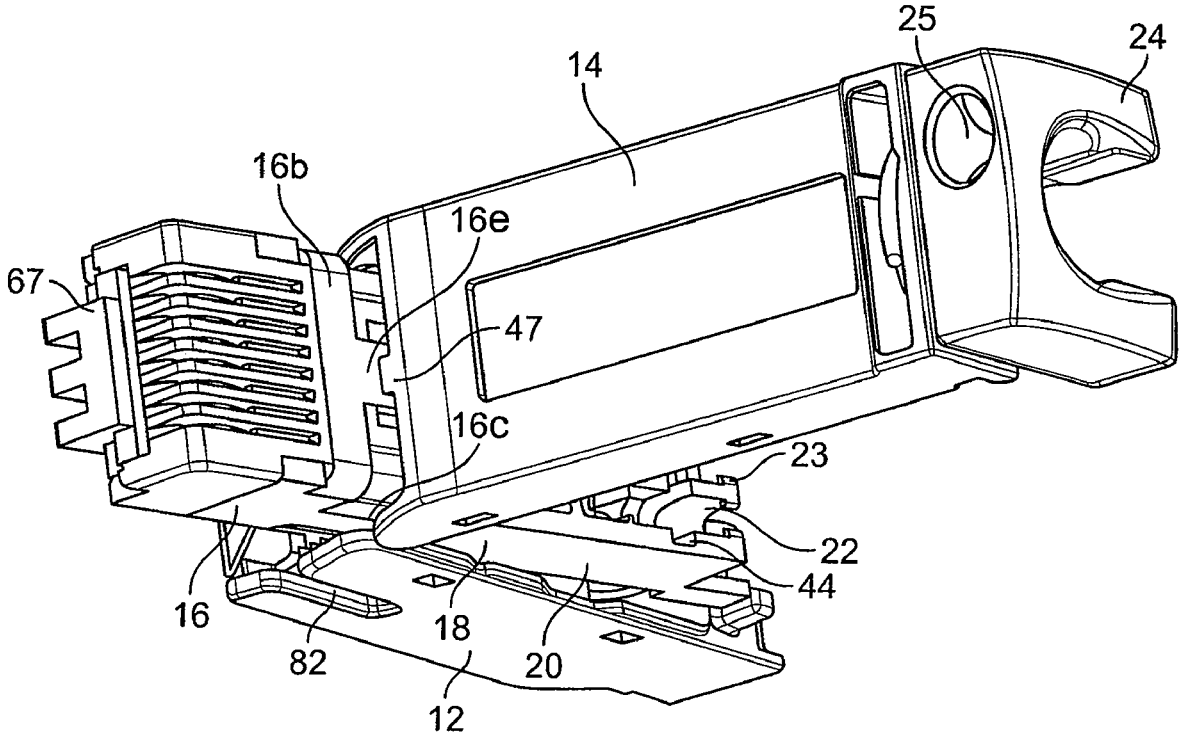
FIG. 7 is another perspective view of the plug of FIG. 4 showing the plug in the open position.

A latching element 16*e* into which a corresponding projection at an end of the second housing 14 can engage or hook, can optionally be provided on the connecting member 16*b* of the third housing 16, as shown in FIG. 7. In this way, a very simple catch can be provided, to hold the second housing 14 in the open position, so it cannot fold together accidentally when it is populated with the conductor elements of the cable (not shown).

As shown in FIG. 4, the detent element 30 has a base 41 provided with lateral locking wings 40 at a front thereof. Each of the locking wings 40 has a locking lug 45 at the lower end thereof. The base 41 has lateral sections 43 which with the locking lugs 45 project laterally outwards. The lateral sections 43 of the base 41 are arranged on a top side of the extension 16*c*, and the locking lugs 45 lock on a bottom side of the extensions 16*c*. The locking wings 45 and the lateral sections 43 of the base 41 have a dimension such that that the seatings 29 for the projections 28 are sufficiently obstructed when the projections 28 are arranged therein so that the projections 28 of the first and second housings 12, 14 can not accidentally be moved out of the seatings 29.

A lever 66 is provided at the rear end of the detent element 30. The lever 66 may be formed or molded to extend diagonal upwards toward the first housing 12. The lever 66 has a downwards directed projection 67 that positions the detent element 30 in a correspondingly shaped seating of the insulation device 18. The first securing elements 62 are arranged on the lever 66. The lever 66 may be a separate piece from or integrally formed with the detent element 30. The lever 66 may be made, for example, from a plastic material.

In order to fix the third housing 16 to the insulation device 18, the third housing 16 is inserted from below into the insulation device 18, which has a correspondingly shaped seating, until the third housing 16 is received substantially flush therewith. The locking wings 40 are inserted into an opening 39 in the insulation device 18 and engage with the extensions 16*c* on the third housing 16. The detent element 30 can be pushed from above onto the insulation device 18 such that the detent element 30 locks on the third housing 16. The third housing 16, the detent element 30, and the insulation device 18 are thereby joined together.

A spring element 68 is provided on the first housing 12. The spring element 68 may be formed from a metal sheet similar to the spring element 60. The spring element 68 has a base 74, a diagonal section 76 and the connecting section 63. The spring element 68 is folded or bent at a front end so that the base 74 extends substantially parallel to the first housing 12. The diagonal section 76 extends diagonally upwards from the base 74 and is connected to the connecting section 63. The connecting section 63 has laterally projecting sections 69 configured to fix the spring element 68 to the first housing 12. A seating 75 extends from an end of the connecting section 63 opposite from the diagonal section 76 and is configured to receive an end of the lever 66. The spring element 68 is positioned in the seating 72 of the first housing 12 by inserting a front of the base 76 and the diagonal section 76 into the seating sections 70. The base 74 is thereby supported in the seating 72 of the first housing 12. The projecting sections 69 are received in lateral ribs 71 of the seating 72 to fix the spring element 68 in the longitudinal direction.

To remove the plug 10 from the plug seating (not shown) pressure is exerted on the diagonal section 76 of the spring element 68 in a direction of the second housing 14. The pressure is either exerted by hand or, if access is difficult, with a tool, such as a screwdriver. The spring element 68 and the lever 66, which is coupled to the spring element 66, are pushed downwards until the first and second securing elements 62, 64 are released from their catch in the plug seating (not shown) so that the plug 10 can be removed from the plug seating (not shown).

To insert a cable into the plug 10, the first housing 12 it rotated upwards from the closed position by, for example, about 10 degrees. As shown in FIG. 5, the spring element 68 remains in the seating 72 of the first housing 12 and coupled to the lever 66. The spring element 68 therefore does not necessarily have to be released from the seating 72 of the first housing 12 to insert a cable into the plug 10.

As shown in FIG. 4, to assemble the plug 10, the first surface of the cable end seating 20 is provided with the conductor elements. The conductor elements are then brought into mechanical and electrical contact with the contact elements 19 by rotating the lower or first housing 12 upwards. Additionally, the first housing 12 can be locked by the securing members 21 formed on the cable end seating 20. The second surface of the cable end seating 20 is then provided with the conductor elements. The conductor elements are then brought into mechanical and electrical contact with the contact elements 19 by rotating the upper or second housing 14 downwards. The first and second housings 12, 14 can be rotated toward the cable end seating 20, for example, by hand. As a result, the plug 10 can be quickly and easily connected. Alternatively, both the upper and bottom sides of the cable end seating 20 could be simultaneously provided with the conductor elements.

The plug 10 according to the first and second embodiments of the invention can be used in many fields, such as office communication technology, industrial plants, rail vehicles and ships. Because of the construction of the plug 10, the seatings 22 can be arranged on several sides of the cable end seating 20, which effectively utilizes the available space in the plug 10. In this way, gigabit-capable plugs can easily be achieved, for example, with the known RJ-45 plug face. In particular, because of the integration of the cable end seating 20 in the insulation device 18, in a traditional 4-pole RJ-45 plug an 8-pole plug arrangement according to the invention can be used. Additionally, the swiveling of the first and second housings 12, 14 allows for easy access to each side of the cable end seating 20 and thus also correspondingly simple, rapid connection of the cable (not shown). A further advantage is that production of the insulation device 18 with the integrated cable end seating 20 is inexpensive and requires less assembly cost than if the parts are produced as individual parts and fitted in the plug 10 independently of each other.

The first, second and/or third housings 12, 14, 16 may be made of metal, as die cast parts. Thus, good shielding and high mechanical robustness can be achieved. Additionally, the robust metal parts or cast metal parts are suitable for industrial use and for use in the office. Further, the locking element 24 can made of metal or plastic. The insulation device 18 and the cable end seating 20 may be made, for example, of an electrically insulating material, such as plastic.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical plug, comprising:

first and second housings rotatable between an open position and a closed position, the first and second housings each having contact elements arranged therein;

a cable end seating arranged between the first and second housings, the cable end seating having a first surface facing an inside surface of the first housing and an opposing second surface facing an inside surface of the second housing, the first and second surfaces each being provided with at least one seating for receiving a conductor element of a cable to be connected to the plug, the contact elements electrically contacting the conductor elements when the first and second housings are in the closed position;

an insulation device integrally formed with the cable end seating; and, a third housing connecting the first and second housings;

wherein the contact elements are insulation displacement connection contacts arranged on the inside surface of the first and second housings.

2. The electrical plug of claim 1, wherein the seatings on the first side of the cable end seating are channels open upwards toward the first housing and the seatings on the second side of the cable end seating are partly closed channels.

3. The electrical plug of claim 1, wherein a printed circuit board element provided with flat contact elements is arranged in the insulation device, the contact elements electrically contacting the flat contact elements when the first and second housings are in the closed position.

4. The electrical plug of claim 1, wherein the insulation device and the cable end seating are an electrically insulating material.

5. The electrical plug of claim 1, wherein a shroud is provided in the cable end seating, the shroud dividing the cable end seating into at least two halves, each of the halves having at least one of the seatings.

6. The electrical plug of claim 1, wherein the first and second housings are metal.

7. The electrical plug of claim 1, wherein at least one securing member is provided on the cable end seating and secures at least one of the first and second housings to the cable end seating.

8. The electrical plug of claim 1, wherein a spring element is provided on the first housing and has securing elements extending therefrom for securing the plug to a plug seating.

9. The electrical plug of claim 1, wherein the first and second housings are separately rotatable between the open position and the closed position.

10. The electrical plug of claim 1, wherein the third housing is engaged with the insulation device.

11. The electrical plug of claim 1, further comprising a detent element fixed to the third housing that secures the first and second housings to the third housing.

12. The electrical plug of claim 1, further comprising a locking element moveable between a locked and unlocked position, the locking element locking the first and second housing in the closed position.

13. The electrical plug of claim 12, wherein the locking element is metal.

* * * * *